US005306430A

United States Patent [19]

Dixon et al.

[11] Patent Number: 5,306,430

[45] Date of Patent: Apr. 26, 1994

[54] ENGINE COOLANT PRESSURE RELIEF METHOD AND APPARATUS

[75] Inventors: Patrick L. Dixon, Riverside, Calif.; Robert B. Sweeney, Forth Worth, Tex.

[73] Assignee: Wynn Oil Company, Azusa, Calif.

[21] Appl. No.: 920,398

[22] Filed: Jul. 27, 1992

[51] Int. Cl.[5] ..... C02F 1/52

[52] U.S. Cl. ..... 210/712; 210/167; 210/765; 137/893; 137/895; 220/202; 220/DIG. 32; 123/41.14; 134/22.18; 165/42; 165/95

[58] Field of Search ..... 137/893, 895; 220/DIG. 32, 202, 203, 303; 165/1, 95, 41, 42, 51; 123/41.14; 210/167, 765, 712, 196, 702, 749; 134/22.18

[56] References Cited

U.S. PATENT DOCUMENTS

| | | | |
|---|---|---|---|
| Re. 31,274 | 6/1983 | Babish et al. . | |
| 1,582,300 | 4/1926 | Otis . | |
| 1,701,824 | 2/1929 | Robinson . | |
| 1,742,281 | 1/1930 | Rundlett . | |
| 2,187,413 | 1/1940 | Boezi et al. . | |
| 2,188,245 | 1/1940 | Middleton . | |
| 3,094,131 | 6/1963 | Williams . | |
| 3,115,145 | 12/1963 | Monteath, Jr. . | |
| 3,409,218 | 11/1968 | Moyer . | |
| 3,540,528 | 11/1970 | Moon . | |
| 3,540,588 | 11/1970 | Estabrook . | |
| 3,776,384 | 12/1973 | Offer . | |
| 3,954,611 | 5/1976 | Reedy . | |
| 4,015,613 | 4/1977 | Papworth . | |
| 4,029,115 | 6/1977 | Wheeler . | |
| 4,052,308 | 10/1977 | Higgs . | |
| 4,054,150 | 10/1977 | Thomas . | |
| 4,083,399 | 4/1978 | Babish et al. . | |
| 4,086,930 | 5/1978 | Hiss . | |
| 4,109,703 | 8/1978 | Babish et al. . | |
| 4,127,160 | 11/1978 | Joffe . | |
| 4,128,140 | 12/1978 | Riches . | |
| 4,161,979 | 7/1979 | Stearns . | |
| 4,167,193 | 9/1979 | Magnus et al. . | |
| 4,176,708 | 12/1979 | Joffe . | |
| 4,209,063 | 6/1980 | Babish et al. . | |
| 4,276,914 | 7/1981 | Albertson . | |
| 4,293,031 | 10/1981 | Babish et al. . | |
| 4,338,959 | 7/1982 | Krueger et al. . | |
| 4,343,353 | 8/1982 | Tsopelas . | |
| 4,366,069 | 12/1982 | Dudrey et al. . | |
| 4,390,049 | 6/1983 | Albertson . | |
| 4,553,587 | 11/1985 | Traylor . | |
| 4,606,363 | 8/1986 | Scales . | |
| 4,615,794 | 10/1986 | Belanger . | |
| 4,671,230 | 6/1987 | Turnipseed . | |
| 4,732,824 | 4/1988 | Howcroft | 165/104.32 |
| 4,790,882 | 12/1988 | Barres . | |
| 4,791,890 | 12/1988 | Miles et al. . | |
| 4,793,403 | 12/1988 | Vataru et al. . | |
| 4,809,769 | 3/1989 | Vataru et al. . | |
| 4,899,807 | 2/1990 | Vataru et al. . | |
| 4,901,786 | 2/1990 | Vataru et al. . | |
| 4,949,682 | 8/1990 | Klein . | |
| 5,021,152 | 6/1991 | Filowitz et al. . | |
| 5,078,866 | 1/1992 | Filowitz et al. . | |
| 5,103,878 | 4/1992 | Cassia | 141/65 |
| 5,114,035 | 5/1992 | Brown | 220/203 |
| 5,169,015 | 12/1992 | Burke | 220/203 |

FOREIGN PATENT DOCUMENTS

| | | |
|---|---|---|
| 1028634 | 5/1953 | France . |
| 1362962 | 4/1964 | France . |
| 2086488 | 5/1982 | United Kingdom . |

OTHER PUBLICATIONS

European Search Report EP 90 10 2607, Jul. 1990.

*Primary Examiner*—Neil M. McCarthy
*Attorney, Agent, or Firm*—William W. Haefliger

[57] ABSTRACT

The method of removing hot liquid coolant from an internal combustion engine cooling system, which includes a radiator having a by-pass outlet, the method including applying suction to the by-pass outlet to draw a by-pass stream of hot fluid, including hot pressurized gas, from the radiator, thereby to reduce fluid pressure in the radiator; and then opening the radiator for safely removing hot liquid coolant therefrom; The removed liquid may be disposed of or treated in a zone or zones outside the cooling system; and returning the treated coolant liquid may then be returned to the cooling system.

27 Claims, 4 Drawing Sheets

ENGINE COOLANT PRESSURE RELIEF METHOD AND APPARATUS

BACKGROUND OF THE INVENTION

This invention relates generally to method employed and apparatus used in conjunction with disposal or cleaning of coolant used in internal combustion engine cooling systems. More particularly, it concerns safety apparatus for relieving fluid pressure build-up in radiators from which coolant is to be removed for disposal or external treatment, including cleaning of the coolant, or to enable coolant system repair.

Studies show that over-heating is a major cause of vehicle breakdown on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break off, and engine blocks can become distorted or crack. Accordingly, there is a need for efficient engine cooling system flushing methods and apparatus; however, flushing of such systems in the past required draining of the removed liquid to sewer or waste lines, which was environmentally objectionable. Accordingly, need has developed for apparatus and method to clean engine coolant systems without such drainage.

U.S. Pat. No. 5,078,866 to Filowitz et al. discloses apparatus and methods for externally treating coolant liquid removed from an engine coolant system. The coolant to be treated is typically removed from the radiator unit associated with the cooling system, and typically via the radiator fill port, after the radiator cap is removed. However, removal of the cap is dangerous when pressure build-up has occurred in the radiator, since the worker can be scalded by steam and hot liquid, if the cap is not properly removed.

There is need for method and means to alleviate this danger, prior to coolant liquid removal for disposal, transfer, inspection, or treatment and return to the coolant system.

SUMMARY OF THE INVENTION

It is a major object of the invention to provide method and apparatus for alleviating the above problems and difficulties. Typically, liquid is to be removed from the cooling system to the exterior of that system, as via an internal combustion engine radiator fill port, there being an overflow by-pass outlet associated with the fill port. The basic method of the invention includes applying suction to the by-pass outlet to draw a by-pass stream of hot fluid, including hot gas, from the radiator, for fluid collection outside the system, prior to cap removal. As will be seen, such suction application is effected by pressurized auxiliary fluid flow aspiration.

Accordingly, when the radiator cap is then removed to enable removal of hot coolant liquid, there is no risk of sudden pressure escape and scalding.

A further object includes providing a conduit having a region of increased flow velocity and reduced flow pressure, flowing pressurized auxiliary fluid through the conduit and region, and communicating the by-pass outlet with the reduced flow area region. The flow of pressurized auxiliary fluid, as for example compressed air through the region of reduced flow pressure, is typically manually controlled, as via operation of a valve in the conduit; and the discharge of removed pressurized coolant fluid via the conduit is observed, as by coolant liquid collection, to indicate to the user when he may close the valve, whereby such by-pass removal of coolant may be minimized. For example, after coolant liquid collection ceases and primarily only gas flow is observed, pressure in the cooling system is thereby indicated to be low enough for safe cap removal. Thereafter, the radiator cap can be safely removed. Such aspiration-removed coolant may then be combined with coolant otherwise removed from the coolant system, for disposal or treatment and resupply to the system. Mixing of the cool, compressed air with hot fluid from the radiator cools that hot fluid, prior to its collection, as will be seen.

Another object includes the provision of an auxiliary ported cap and attaching the auxiliary cap to the radiator at the fill port, and effecting the removal of hot liquid from the radiator interior via the ported auxiliary cap. An elongated tube may then be provided and extended into the radiator via the ported cap, for removing hot liquid via the tube, for external treatment, as referred to.

In its apparatus aspects, the invention concerns provision of means for applying suction to the by-pass outlet to draw a by-pass stream of hot fluid, including hot pressurized gas from the radiator, thereby to reduce fluid pressure in the radiator, whereby the radiator may then be opened for safely removing hot liquid coolant therefrom. Such means may typically include a conduit having a bore region of increased flow velocity and reduced flow pressure, means to supply pressurized auxiliary fluid for flow through the region, and means to communicate the by-pass outlet with the region, at the side thereof. The bore region referred to typically has venturi shape. Control valve means may be provided in series with that conduit for controlling the flow of the pressurized auxiliary fluid through the region, thereby to control drawing of the by-pass stream from the radiator.

These and other objects and advantages of the invention, as well as the details of an illustrative embodiment, will be more fully understood from the following specification and drawings, in which:

DRAWING DESCRIPTION

DETAILED DESCRIPTION

Figures 5, 5A:
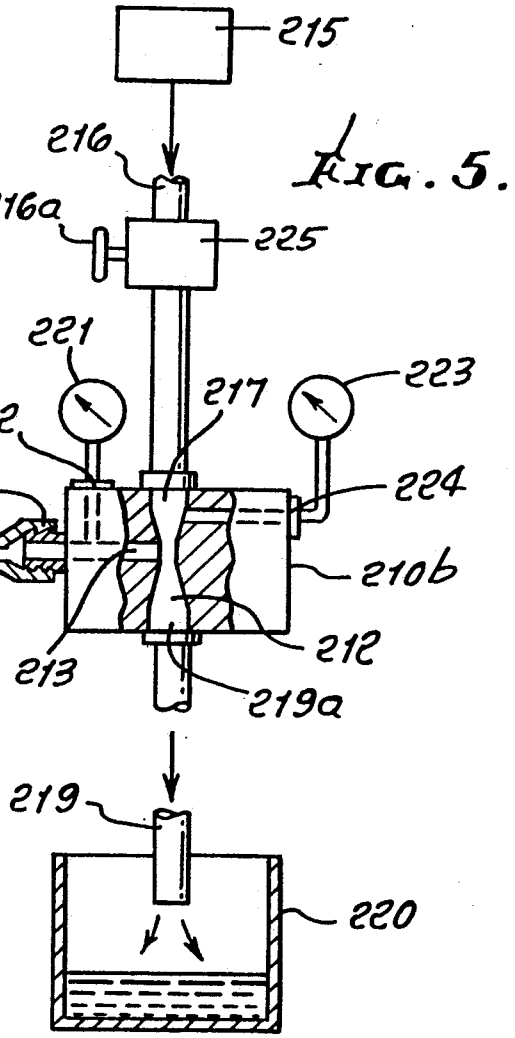
FIG. 5 is an enlarged view showing the suction application apparatus, as applied to a by-pass port at the radiator fill port.
FIG. 5*a* is a view of a closed radiator pressure relief valve.

Referring first to FIG. 5, the internal combustion engine radiator 12 has a fill opening 23*a*. A screw-on cap 24*a* is thread attached to the neck 25*a* of the radiator fill opening, as at 24*b*. A compression spring 200 is carried by the cap at 200*a* and projects downwardly within the neck 25*a*. A pressure relief valve stopper 203 is urged downwardly by the spring 200 to seat at the valve stopper periphery against an annular shoulder 207 defined by the radiator structure below the neck 25*a*. Accordingly, a pressurized coolant system is maintained in the radiator below the escape pressure level. FIG. 5*a* shows normal operation with vent valve 110 open.

On the other hand, if the cap is not carefully removed, the operator can be harmed, as by scalding or by becoming struck by the explosively pressure-driven cap, as it is unscrewed. Such cap removal is required to enable removal of coolant liquid from the radiator interior, for external treatment, as will be described in connection with FIGS. 1–4.

In accordance with the invention, means is provided to apply suction to the by-pass outlet, as at nipple 204, to draw a by-pass stream of hot fluid, including hot gas from the radiator, for reducing the pressure in the latter. Aspiration apparatus is provided to apply such suction, the aspirating fluid mixing with the hot aspirated coolant to reduce its temperature and disperse it, for safe collection.

Referring to FIG. 5, the aspiration apparatus includes a conduit having a bore region of increased flow velocity and reduced flow pressure, means to supply pressurized auxiliary fluid for flow through the bore region, and means to communicate the by-pass outlet with the bore region, at the side thereof. See for example conduit 210 having a hose section 210*a* with one end 210*a'* applied to the nipple 204. The opposite end of section 210*a* is connected to conduit body 210*b*, as via hose barb 210*b*. Body 210*b* has internal venturi passage 212, to the side of which conduit section 210*a* is connected, via passage 213. A source 215 of compressed air is connected via hose 216 with the body passage 217 that communicates with one end of the venturi passage 212. A discharge hose 219 connects at one end 219*a* with the venturi passage, to receive flow of compressed air. Hose 219 discharges into a recovery tank 220, whereby the compressed air dissipates and any coolant liquid withdrawn from the radiator neck is collected in tank 220, to be disposed of or to be added to the coolant otherwise withdrawn from the radiator for treatment. Note valve stopper 203 raised off seat 207, and vent valve 110 closed, due to pressure in the radiator. Note also vacuum pressure indicator gage 221 connected to body 210*b*, at 222, and air pressure indicator gage 223 connected to body 210*b* at 224, these elements being useful but can be omitted.

A manually operable valve 225 is connected in series with hose 216, as shown, and is controllably opened by handle 216*a*, as needed to effect sufficient flow of compressed air to withdraw hot coolant from the radiator, via hose section 210*a*, for reducing pressure in the radiator at 23*b* to a safe level allowing safe removal of cap 24*a*. Suction applied to the radiator neck also serves to open check valve 203 proximate that neck, and normally serving to prevent pressure release below a predetermined pressure level.

The method of operation in relation to coolant removed for external treatment includes:

a) applying suction to the by-pass outlet to draw a by-pass stream of hot fluid, including hot pressurized gas, from the radiator, thereby to reduce fluid pressure in the radiator, and b) then opening the radiator for safely removing hot liquid coolant therefrom.

In this regard, the method may include treating the removed liquid in a zone or zones outside the cooling system, and returning the treated coolant liquid to the cooling system.

It will be noted that the method involves operating the control valve 225 to control movement of the seal valve stopper 203 acting to pass pressurized fluid in the radiator to the by-pass outlet. For example, the control valve is opened sufficiently to effect aspiration of pressurized fluid past the valve 203 and to the outlet 202 in an amount to drop the pressure in the radiator to a safe level enabling opening and removal of the gap 24*a*. At that point, liquid coolant may be removed from the radiator for external treatment as desired, or other disposition. Alternatively, liquid coolant may be drained from the radiator as at the bottom thereof, while the cap 24*a* is left in position on the neck. See bottom drain valve 265 in FIG. 2.

Figure 1:
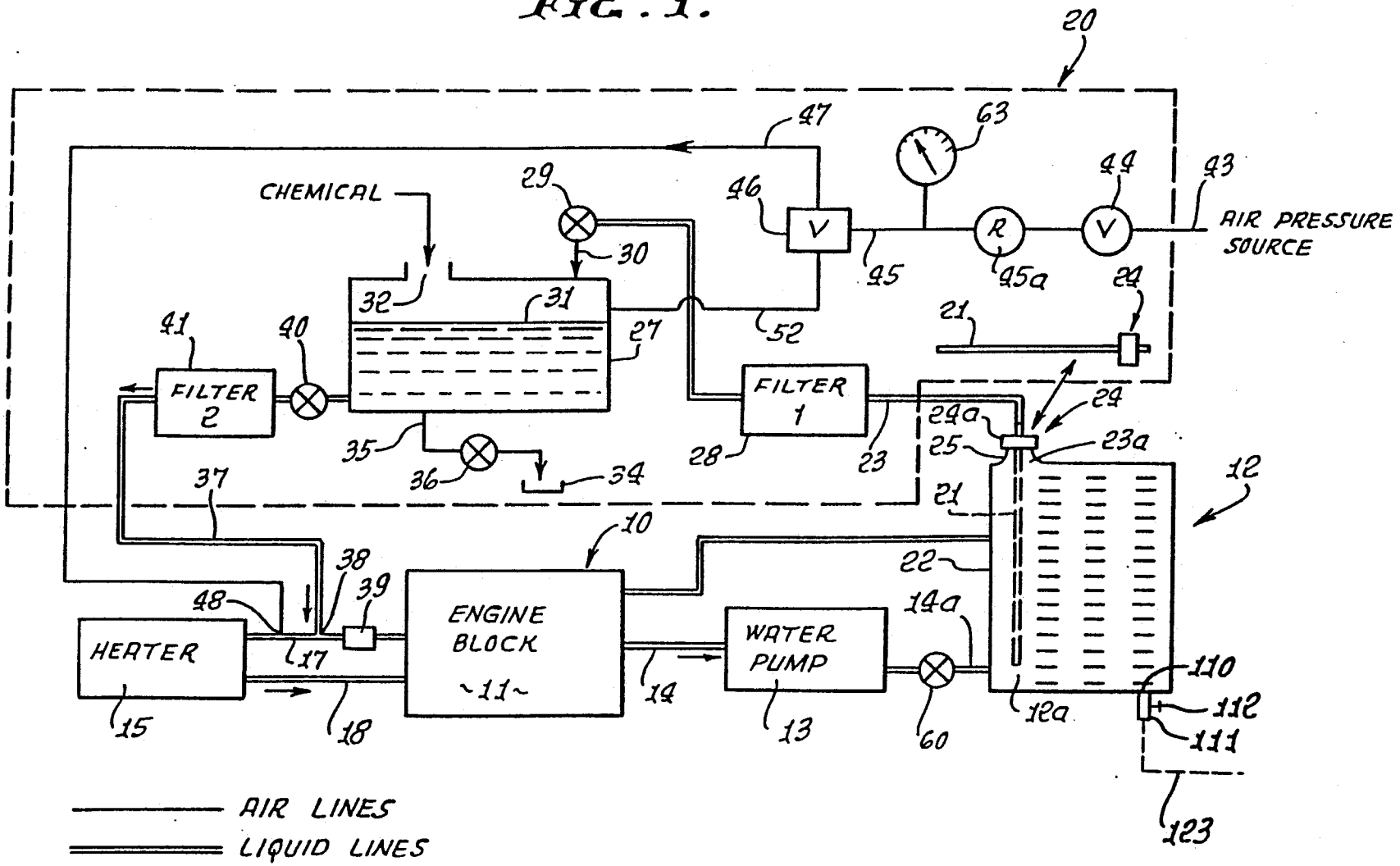
FIG. 1 is a schematic view of overall apparatus employing the invention.

With respect to those steps, FIG. 1 schematically shows an internal combustion engine 10 having a block 11 defining a coolant passage through which liquid coolant (such as water and anti-freeze additive, including polyethylene glycol, etc.) is adapted to pass, a radiator 12, and a coolant pump 13 connected to pump coolant between the block and radiator, as via lines or ducts 14 and 14*a*. Also shown is a heater 15 connected at 17 with the block, as for use in a vehicle to be heated. From the heater, coolant may pass at 18 to the engine block 11. During continued operation of the engine, the coolant tends to become contaminated with particulate, such as rust particles and precipitate (calcium salts, etc.), and the additive degenerates. In the past, the coolant was drained from the system as to sewer lines, and the system flushed with liquid, which was also drained. The overall method eliminates such environmentally objectionable draining, and also protects the operator. In this regard, apparatus generally designated at 20 is provided, and comprises:

a) first mean for forcing the coolant liquid from the cooling system to the exterior of that system, b) second means in communication with the first means for receiving the coolant liquid at the exterior of the cooling system, for treatment thereof, and c) third means in communication with the second means for returning the treated coolant liquid to the cooling system.

While specific means are shown within the overall block 20, it will be understood that other, or equivalent means, are usable to perform the following steps:

a) forcing the liquid coolant from the cooling system to the exterior of that system, b) treating the coolant liquid in a zone or zones outside the cooling system, the treating including removing contaminant from the coolant liquid, and c) returning the treated coolant liquid to the cooling system.

In this regard, it will be noted that the method and apparatus makes possible the reuse of the coolant by safely withdrawing it from the coolant system, after de-pressurization, as described, treating it externally of that system, and recirculating the rejuvenated coolant back into the system so as to avoid need for disposal of the coolant, as by drainage to the environment.

Figure 2:
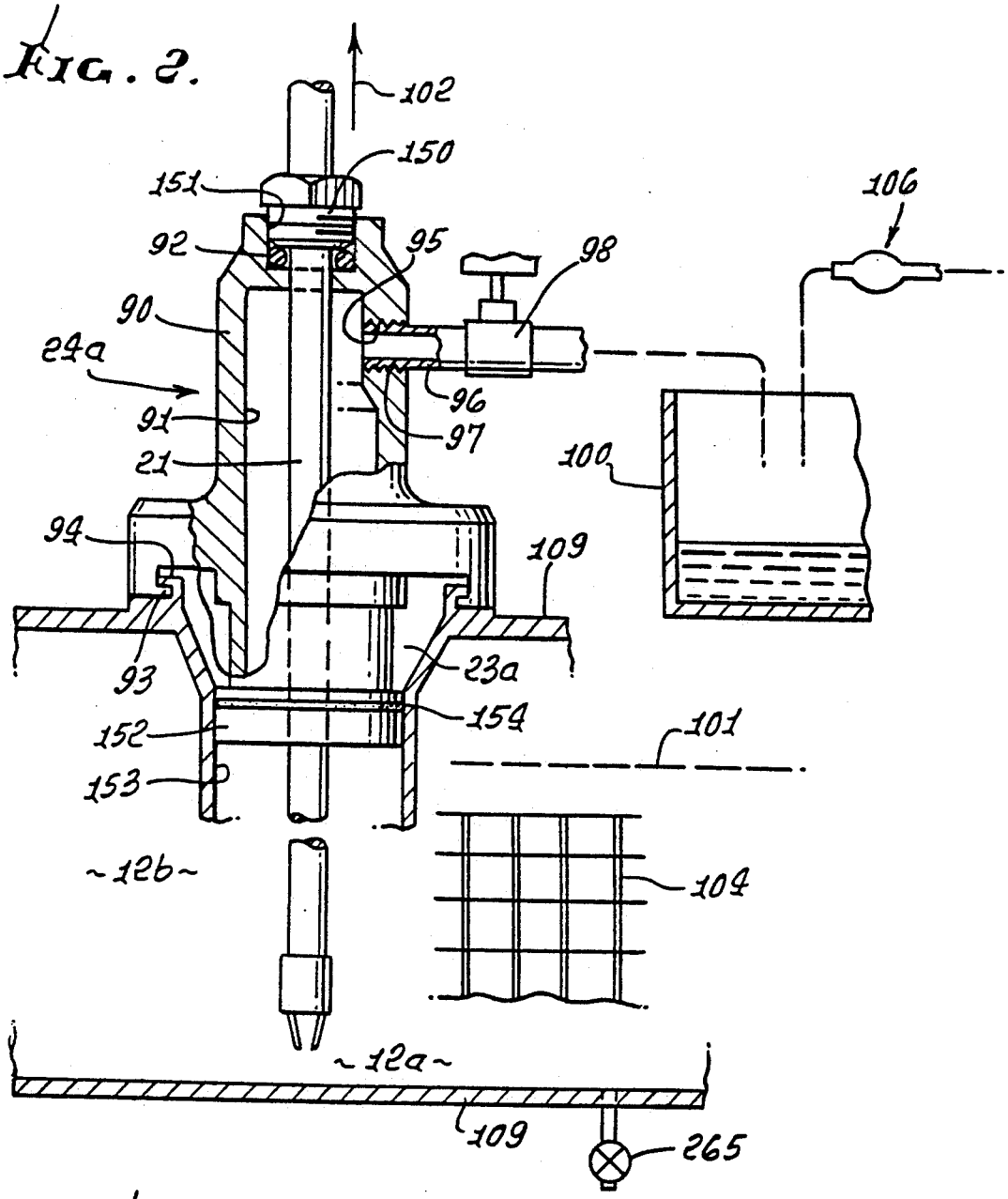
FIG. 2 is an enlarged section showing details of a radiator fill port closure at a by-pass valve.

The specific means illustrated incorporates multiple and unusual advantages in terms of simplicity, effectiveness and rapidity of employment and operation; for example, the first means for forcing the liquid coolant from the coolant system may advantageously include an elongated tube or tubular probe 21 insertible endwise into the outer container or shell 22 incorporated by the radiator, and via the usual fill opening 23a of that shell to extract coolant from the lower interior or extent of the radiator, for passage from the radiator, as via duct 23. Means 24 associated with, and typically carried by that tubular probe 21, is provided for maintaining the fill opening otherwise closed during removal of coolant from the radiator. Such means may comprise a screw-on cap 24 which is annular to pass the elongated tube 21. Cap is screwed onto the neck 25 of the radiator fill opening, after removal of cap 24a as referred to above, the probe then reaching or extending to the bottom interior of the radiator so that substantially all liquid may be removed, extracted or siphoned from the radiator to the line 23. As will appear, liquid in the heater and block flows to the radiator for such removal, and typically under pressure within the radiator so as to flow up the tubular probe to the external line 23 and then to a treatment zone. FIG. 2 shows cap details.

The second means for treating the removed coolant may advantageously comprise a liquid receiver, such as for example, a holding tank 27 to which liquid flows via line 23, filter 28 connected in series with that line, and valve 29 in the line. Particulate and congealed substances in the flowing liquid are removed by the filter 28, which may be replaced at intervals; the used-up filter then being disposed of in accordance with environmentally acceptable safe procedures. The normally aqueous liquid received into the holding tank interior zone 31, as via inlet 30, may then be treated, as by addition of chemical agent or agents introduced via port 32. Such chemicals may include corrosion inhibitor, i.e., anti-rust compounds, pH adjustment chemicals, and fresh anti-freeze compound (glycol, for example). If any sludge develops in tank 27 after prolonged use, it may be removed to a container 34 and disposed of, environmentally safely. See line 35 and valve 36.

The third means for returning the treated coolant to the engine cooling system includes a line or duct 37 extending from tank 27 to a connection 38 with the cooling system. Connection 38 is advantageously located in the line 17 from the block 11 to the heater. A clamp 39 may be located on or at that line for stopping liquid passing from 38 to the block, via line 17. A control valve 40 and a filter 41 are connected in series with line 37, valve 40 being opened when return of coolant to the system is desired. Filter 41 removes any further contaminant.

In association with the first means referred to above, a pressurized gas (as for example air pressure) source 43 is connectible via a main valve 44 in duct 45 and a control valve 46, connected via duct 47 with the coolant system, for forcing coolant from that system and to tank 27 (as via the probe 21 and line 23). Line 47 may be connected to duct 17, at 48, as shown. Air pressure then drives coolant from the heater to the radiator, as via line 18, and the pump 13, coolant also flowing from the block to the radiator lower interior extent 12a, for pick up by the probe 21.

Valve 46 is advantageously a three-way valve and is thus controllable to alternatively supply air under pressure via line 52 to the holding tank interior for application to treated liquid 31 in the tank for return supply under pressure to the engine cooling system, along the flow path described above.

Prior to initial operation of the system, the engine is operated, if necessary, to heat the coolant in the system; and as a result, a thermostat-controlled valve in that system, indicated at 60, is opened when the coolant reaches a predetermined temperature. Rust loosening or cleaning chemical additive (such as detergent solution) may be initially added to the coolant in the radiator to circulate during warm-up. The probe 21 is then inserted in the radiator, and operation of the apparatus is begun. Note that the apparatus is quickly connectible to the cooling system, as via hoses or lines 23, 37 and 47.

A pressure gauge 63 is connected to air line 45 to indicate the pressure in that line. After air pressure has returned the treated coolant to the system, the radiator fill opening 23a is closed, as by returning the radiator cap to neck 25, and tightening it to seal the opening 23a. Thereafter, air pressure from supply 43 pressurizes the entire coolant system, and gauge 63 is observed to note the pressure. Air pressure regulator 45a in line 45 regulates the pressure to a safe level. Valve 44 is then closed, and the gauge 63 is again observed to note any relatively rapid fall-off of pressure. If that does not occur, the pressure test indicates a non-leaking system; however, if the pressure falls off, the test indicates that a leak has developed in the coolant system and should be attended to. For example, a STOP-LEAK solution may be added to the contents of the radiator in an effort to arrest the pressure leak.

In FIG. 2, the modified cap 24a has a domed wall 90 with a central through opening 91 to pass tubular probe 21. A seal 92, carried by the cap, seals off against the outer surface of the probe (which may be plastic) when threaded fitting 150 is tightened in threaded bore 151. The probe is axially shiftable, endwise, relative to opening 91, when fitting 150 is loosened. The cap has a lower lip 93 that tightens on the annular lip 94 of the radiator container, as shown, at which time an annular extension 152 fits in radiator bore 153, sealing at 154. An off-set through port 95 has a by-pass duct 96 connected therewith at 97, and a manually controllable by-pass valve 98 in duct 96 controls escape of pressurized fluid from the radiator upper interior 12b, and to an overflow tank 100. By-pass valve 98 is opened, as during air pressure induced return of treated coolant fluid to the system, that fluid allowed to rise in the radiator, to level 101, above indicator core 104. Any excess fluid (air or coolant or both) rising in the radiator exits via the by-pass duct and valve 98 to tank 100. Thus, hot fluid under pressure cannot discharge in direction 102, outside probe 21, since the radiator fill port 23a is closed by cap or closure 24a. Duct 96 is transparent so that any loss of coolant can be visually monitored. Coolant collected in tank 100 can be returned to tank 27, as by siphoning. See siphon 106. The radiator container or shell appears at 109.

Figure 4:
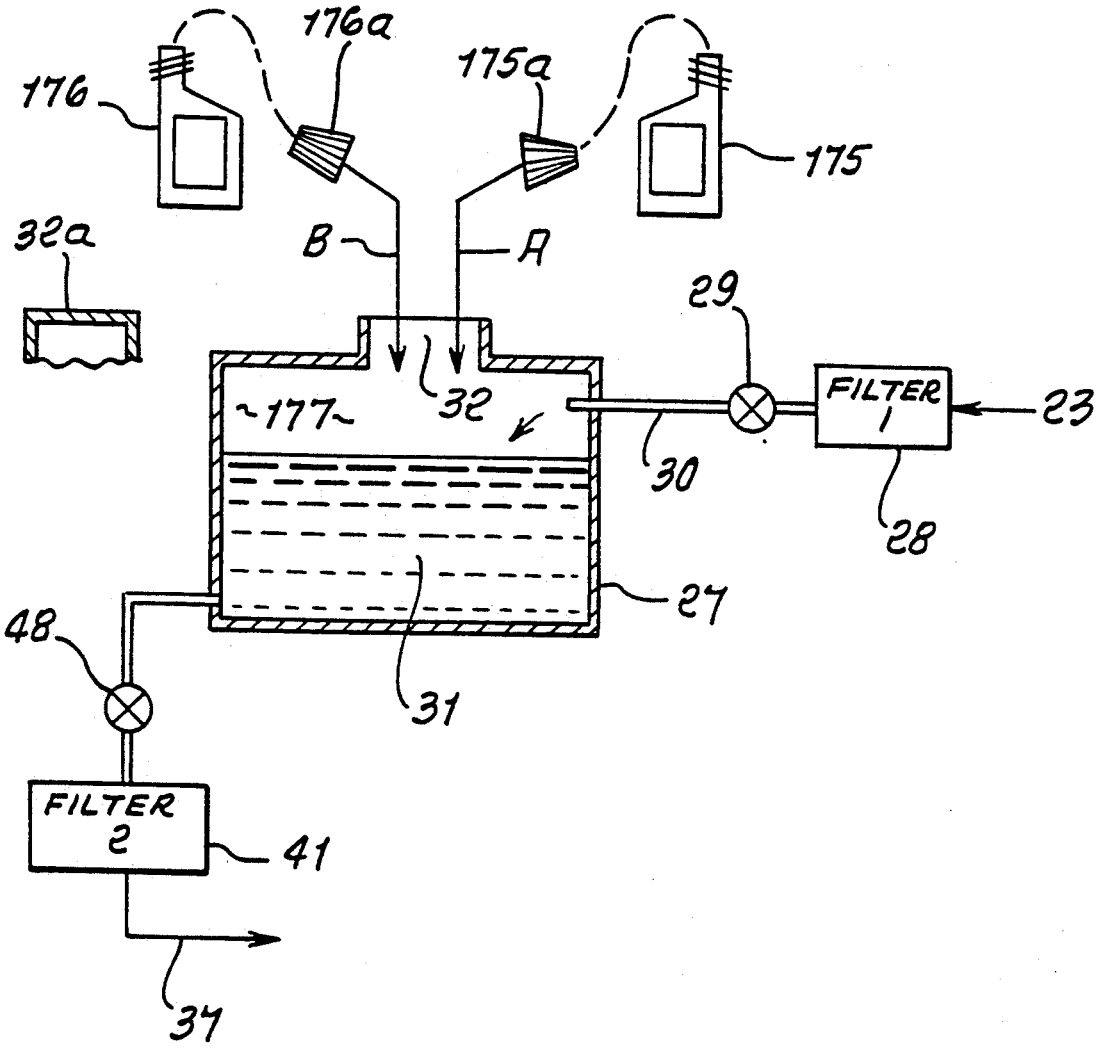
FIG. 4 is a fragmentary view of system components.

Referring to FIG. 4, elements corresponding to those in FIG. 1 bear corresponding identifying numerals. Also shown are two bottles 175 and 176 for polymeric compositions indicated at A and B as being poured (sequentially) into the coolant liquid being turbulently filled into the container 27, as via line 30. Accordingly, good mixing of A and B with the coolant liquid in the container interior zone 177 is obtained. The method involves treating (as by mixing) of the normally cloudy coolant liquid 31 with first A and then B, thereby effecting precipitation of anions, and cations, in the coolant liquid to produce particle form contaminant (particulate), which is then filterable at 41, as the treated coolant liquid is returned, under pressure, to the cooling system via 40, 41 and 37, as described above. Such precipitate is normally over about 5 microns in size. The filtered coolant at 37 is a clear liquid.

Typically, the precipitating compositions A and B are in liquid form and are added to the coolant 31 being filled into 27, as via dispensers 175*a* and 176*a*, such as hollow caps for the bottles 175 and 176 in which A and B are supplied. First composition A precipitates anions (such as sulfate, chloride, etc.); and second composition B precipitates cations (such as metal ions, i.e., of lead, iron, copper, etc.) found in coolant liquid circulating in engine coolant systems, as described above.

The two compositions are synthetic polymers and polyelectrolytic, and typically in aqueous solution in the bottles. An example of the relative proportions of the mix is as follows (for complete or substantially complete precipitation of the anion and cation contents of normal radiator coolant, in terms of stoichiometric equivalence):

about 3 gallons of coolant liquid consisting essentially of polyethylene glycol, water, dissolved salts, and particulate;

about ¼ to ¾ ounce of said first composition PROTAZYNE, which is an 8% aqueous solution of cationic polyelectrolyte, or equivalent;

about ½ to 1½ ounces of said second composition NETAMOX, which is a 5% aqueous solution of anionic polyelectrolyte, or equivalent, and a 5% aqueous solution of heavy metal precipitant.

Composition B (the NETAMOX) preferably contains, as a portion of the ½ to 1½ ounces, the heavy metal precipitant sodium dimethyl dithiocarbamate in 0.5% to 1.5% aqueous solution form.

More specifically, the anionic polyelectrolyte in composition B is sold under the trade name HYROFLOC 495L (produced by Aqua Ben Corp., Orange, Calif.) and has a boiling point of about 220° F., a specific gravity 1.02 gm/cc, a pH of about 8.2, and a chemical formula:

$$-CH_2-\underset{\underset{X}{|}}{CH}.n$$

The "PROTAZYNE" composition A is a cationic polyelectrolyte sold under the trade name HYDROFLOC 865 (produced by Aqua Ben Corp., Orange, Calif.), and has a boiling point of about 220° F., a specific gravity of 1.0, vapor pressure 17.5 mm Hg, vapor density of 1, pH of 6, and chemical formula:

$$-CH_2-\underset{\underset{X}{|}}{CH}.n$$

The following tables illustrate results obtained in terms of metal ion reduction:

TABLE I

COOLANT ANALYSIS BEFORE AND AFTER TREATMENT

| | 1971 Ford Pinto 144.6K Miles | | 1977 Dodge Van 103.9K Miles | |
|---|---|---|---|---|
| | Before | After | Before | After |
| Fe[1] | 15.5 | <0.1 | 59.4 | 2.2 |
| Pb[1] | — | — | 13.0 | <0.1 |
| Cu[1] | 12.0 | <0.1 | 6.2 | <0.1 |

[1](ppm) by AA

TABLE II

COOLANT ANALYSES BEFORE AND AFTER TREATMENT

| | 1985 Nissan Pickup 64K Miles | | 1986 Merkur XR4T 54.4K Miles | | 1984 Chrysler Dodge Daytona 79.7K Miles | | 1977 NISSAN 200SX 135.2K Miles | |
|---|---|---|---|---|---|---|---|---|
| | Before | After | Before | After | Before | After | Before | After |
| Pb[1] | 0.2 | <0.1 | 18.3 | <0.1 | 24.5 | <0.1 | 42.0 | <0.1 |
| Fe[1] | 0.1 | <0.1 | 28.4 | <0.1 | 21.4 | <0.1 | 5.5 | <0.1 |
| Cu[1] | — | — | — | — | 20.6 | <0.1 | 1.0 | <0.1 |

[1]= (ppm) by AA

TABLE III

ANALYSIS OF MARK X FILTERS (SEE FILTER 41) AFTER TREATING CARS IN THE FIELD

| | 1975 Ford Ltd 109.6K Miles | | 1978 Chevrolet Monza 138.5K Miles | | 1979 Pontiac Firebird 163K Miles | | 1964 Chevrolet Impala 156.6K Miles | |
|---|---|---|---|---|---|---|---|---|
| | Primary | Secondary | Primary | Secondary | Primary | Secondary | Primary | Secondary |
| Fe[1] | 17.9 | 22.2 | 11.4 | 0.9 | 14.6 | 4.6 | 10.6 | 9.6 |
| Pb[1] | 11.6 | 2.9 | 4.6 | 4.2 | 2.2 | 1.5 | 6.2 | 3.5 |
| Cu[1] | 7.9 | 24.6 | 15.4 | 289.0 | 28.6 | 94.6 | 15.9 | 94.6 |

[1]= (ppm) by AA

Figure 3:
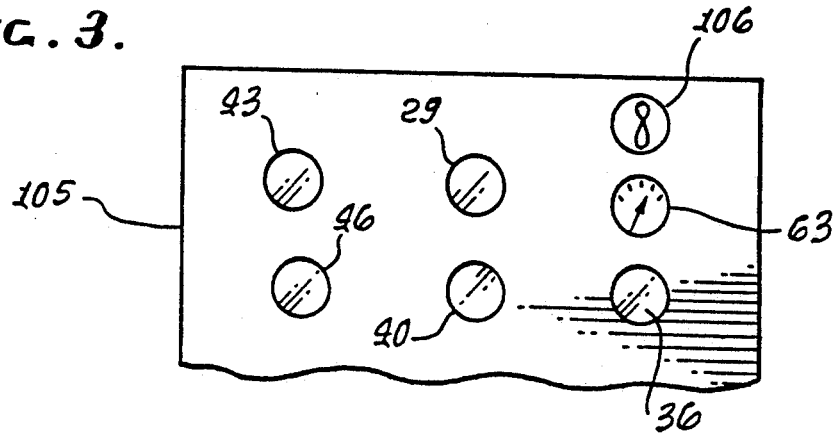
FIG. 3 is a front view of a control console.

FIG. 3 shows valve controls on a console panel 105, along with gauge 63. A flow indicator (spinner) connected into line 17, is shown at 106.

I claim:

1. In the method of removing hot liquid coolant from an internal combustion engine cooling system, which includes a radiator having a fill port, a pressure cap and a by-pass outlet located near said fill port, there being a venturi-type suction/aspiration mechanism in fluid flow communication with said by-pass outlet, the method including a) applying suction to withdraw hot fluid, including hot liquid and pressurized gas, from the radiator via said outlet and said mechanism, prior to removal of said cap, and b) then opening the radiator by removal of said cap, for safely removing hot liquid coolant therefrom.

2. The method of claim 1 wherein said application of suction is effected by pressurized auxiliary fluid flow application to said venturi-type suction/aspiration mechanism.

3. The method of claim 1 including c) treating the removed liquid in a zone or zones outside the cooling system, d) and returning the treated coolant liquid to the cooling system.

4. The method of claim 2 which includes providing a conduit having a region of increased flow velocity and reduced flow pressure, flowing pressurized auxiliary fluid through said conduit and region, and communicating said by-pass outlet with said reduced flow pressure region.

5. The method of claim 4 including controlling the flow of said pressurized auxiliary fluid through said region.

6. The method of claim 2 wherein said pressurized auxiliary fluid comprises one of the following:

i) compressed gas ii) compressed air.

7. The method of claim 5 wherein said pressurized auxiliary fluid comprises compressed air, and said controlling includes providing a control valve in series with said conduit, and intermittently operating said control valve.

8. The method of claim 7 wherein said pressure cap closes said fill port, said cap carrying a spring-urged pressure seal valve.

9. The method of claim 2 including collecting and observing said collection of hot liquid removed from the radiator via said by-pass outlet, and controlling said flow of said pressurized auxiliary fluid to change the rate of said flow depending upon said observed collecting.

10. The method of claim 3 wherein said application of suction is effected prior to said removal of hot liquid from the cooling system for treatment.

11. The method of claim 9 wherein said radiator includes a cap on said fill port, and said method includes removing said cap to gain access to the radiator to enable said removal of hot liquid coolant, and said application of suction to the by-pass outlet is effected prior to said removal of the cap.

12. The method of claim 11 wherein said cap comprises a ported auxiliary cap, and including the steps attaching said auxiliary cap to the radiator at said fill port, and effecting said removal of hot liquid from the radiator interior via said ported auxiliary cap.

13. The method of claim 12 which includes providing an elongated tube, and extending said tube into the radiator via said ported auxiliary cap, and removing said hot liquid via said tube.

14. The method of claim 1 including a safety check valve normally preventing escape of coolant via said by-pass outlet, and wherein sufficient of said suction is applied to open said safety check valve, said safety check valve being associated with said fill cap.

15. The method of claim 1 including disposing of said hot liquid withdrawn from the radiator.

16. The method of claim 1 wherein said step a) includes collecting hot liquid removed from the radiator via said by-pass outlet.

17. The method of claim 16 including returning to the cooling system collected liquid removed from the radiator via said by-pass outlet.

18. The method of claim 16 wherein the by-pass outlet is located near a radiator fill port having a cap there on, and including removing said cap only after completion of said step a).

19. For use in facilitating removal of hot liquid coolant from an internal combustion engine cooling system, which includes a radiator having a fill port, a pressure cap, and a by-pass outlet located near said fill port, the improvement comprising:

a) means including a venturi-type suction/aspiration mechanism in fluid flow communication with said by-pass outlet for applying suction to the by-pass outlet to withdraw hot fluid including hot liquid and pressurized gas from the radiator via said outlet and said mechanism, prior to removal of said cap, thereby to reduce fluid pressure in the radiator, whereby the radiator may then be opened by removal of said cap for safely removing hot liquid coolant therefrom.

20. The apparatus of claim 19 wherein said mechanism includes a conduit having a bore region of increased flow velocity and reduced flow pressure, means to supply pressurized auxiliary fluid for flow through said region, and means to communicate said by-pass outlet with said region.

21. The apparatus of claim 20 wherein said region has venturi configuration.

22. The apparatus of claim 20 including control valve means in series with said conduit for controlling the flow of said pressurized auxiliary fluid through said region, thereby to control drawing of said by-pass stream from the radiator.

23. The combination of claim 19 including a safety check valve carried by said cap to control escape of coolant fluid from the radiator.

24. A method of treating cooling liquid in an internal combustion engine cooling system comprising removing coolant liquid from the cooling system, treating the coolant liquid and returning it to the cooling system, the system having a radiator having a fill port, a pressure cap and an overflow port located near said fill port said method comprising a) initially applying suction to the cooling system via said overflow port, said suction being applied via a venturi-type suction/aspiration mechanism in fluid flow communication with said overflow port prior to removal of said pressure cap, b) forcing the coolant liquid from the cooling system to the exterior of that system by supplying pressurized fluid to the cooling system to drive coolant liquid therefrom, c) treating the coolant liquid in a holing zone or zones outside the cooling system, said treating including collecting the coolant liquid in a holding zone, adding chemical agent or agents to the collected liquid in the holding zone, and removing contaminant from the coolant liquid, and d) returning the treated coolant liquid to the cooling system.

25. The method of claim 24 wherein said forcing step includes employing said pressurized fluid to drive coolant liquid from the radiator via said fill port.

26. A method for reducing fluid pressure within a radiator, prior to removal of a radiator pressure cap, there being a by-pass outlet from the radiator proximate to a radiator fill port, including a) providing a venturi-type suction/aspiration mechanism in fluid flow communication with said by-pass outlet, b) and applying suction to withdraw hot liquid and gases from the radiator via said by-pass outlet and via said mechanism.

27. Apparatus for reducing fluid pressure within a radiator, prior to removal of a radiator pressure cap, comprising a) a by-pass outlet from the radiator proximate to a radiator fill port, and b) a venturi-type suction/aspiration mechanism in fluid flow communication with said by-pass outlet, c) whereby suction may be applied to withdraw hot liquid and gases from the radiator via said by-pass outlet and via said mechanism.

* * * * *